US005397764A

United States Patent [19]

Yokoyama et al.

[11] Patent Number: 5,397,764

[45] Date of Patent: Mar. 14, 1995

[54] THERMAL TRANSFER RECORDING FILM

[75] Inventors: Kazuo Yokoyama, Sagamihara; Takashi Yamagishi, Yokohama, both of Japan

[73] Assignee: Teijin Limited, Osaka, Japan

[21] Appl. No.: 35,588

[22] Filed: Mar. 23, 1993

[51] Int. Cl.[6] ..... B41M 5/40

[52] U.S. Cl. ..... 503/227; 428/195; 428/447; 428/488.4; 428/913; 428/914

[58] Field of Search ..... 428/195, 488.4, 913, 428/914, 447; 503/227

[56] References Cited

U.S. PATENT DOCUMENTS

| | | | |
|---|---|---|---|
| 4,717,711 | 1/1988 | Vanier et al. | 503/227 |
| 4,737,485 | 4/1988 | Henzel et al. | 503/227 |
| 4,866,026 | 9/1989 | Henzel et al. | 503/227 |

FOREIGN PATENT DOCUMENTS

| | | | |
|---|---|---|---|
| 0138483 | 4/1985 | European Pat. Off. | 503/227 |
| 0163145 | 12/1985 | European Pat. Off. | 503/227 |
| 60-94390 | 5/1985 | Japan | 503/227 |
| 61-143195 | 6/1986 | Japan | 503/227 |

*Primary Examiner*—Pamela R. Schwartz
*Attorney, Agent, or Firm*—Wenderoth, Lind & Ponack

[57] ABSTRACT

A thermal transfer recording film is provided which has a thermal transfer recording layer on one surface of a film base, the unique feature residing in that a back-coat layer containing silicone as fixed on a binder resin and a fluorine-containing surfactant is provided on the surface of the film which comes into sliding contact with a thermal head. This product is free of sticking, excels in slidability on a thermal head, and causes little silicone transfer from the back-coat.

3 Claims, No Drawings

THERMAL TRANSFER RECORDING FILM

This invention relates to a thermal transfer recording film. More particularly, the invention relates to a thermal transfer recording film which is characterized in that a back-coat layer containing silicone as fixed on a binder resin and a fluorine-containing surfactant is provided on the film surface which comes into sliding contact with a thermal head.

Recent progress in color hard copying technology at picture output terminals, to keep pace with the progress in picture processing system, CAD, computer graphics and the like centering around work stations and personal computers, is indeed remarkable. Also as outputs from video and still cameras, needs for color hard copies are great.

Those representative of color hard copying technologies include methods using conventional silver salt photographs, ink-jet, electrographs and thermal transfer process. Of those, thermal transfer process has such merits as simple operation, handy use, and that apparatuses used therefor have simple construction, easy size reduction and maintenance and, moreover, the apparatuses themselves are cheap.

A thermal transfer system forms pictures by heating heat-meltable ink or dye imagewise by a thermal head, laser beam or the like and transferring the image onto a receiving body. At present, a method using a linear thermal head is most commonly employed.

In said method, an ink sheet and picture-receiving body are nipped between a thermal head and nip rolls, and heating is effected with the thermal head from behind the ink sheet (the opposite side to the ink layer) to cause transfer of the meltable ink or dye onto the picture-receiving body which is in intimate contact with the ink sheet to form intended images. Therefore, the particular surface of the ink sheet which comes into sliding contact with the thermal head is required to have slidability in heated condition.

On the other hand, requirements for the heating conditions with thermal heads are becoming more and more rigorous in these years, to meet the needs for higher speed printing and adaptability to sublimation-type printers.

Generally as a support layer of an ink sheet, polyethylene terephthalate film is frequently used, in consideration of costs and thermal stability. However, the use of said film is apt to cause a phenomenon which is commonly referred to as sticking, as the surface portion of the film base melts under the heating with a thermal head and sticks to the thermal head. This phenomenon prevents smooth running of the ink sheet, causes noises in the transferred pictures (stick marks) and in extreme cases results in ink sheet breakage.

While it is effective to use films excelling in thermal stability such as an aromatic polyamide film, they are still too expensive compared to polyethylene terephthalate films and unfit for practical usage.

Under the circumstances, it is widely practiced to provide a back-coat having both thermal stability and slidability, on the surface (of the side opposite to the ink layer) of the film which comes into sliding contact with a thermal head.

As a back-coat satisfying the required performance, silicone is well known. However, silicone generally exhibits poor adherability to the film base, and when the film is taken up into a roll, it is apt to be transferred to the opposite surface. The silicone so transferred frequently becomes the cause of application defect such as repellence during coating of the ink layer. It might be proposed to coat the ink layer before applying the back-coat, but in that case silicone transfer from the back-coat to the ink layer takes place. So transferred silicone on the ink layer hinders the ink transfer from the ink layer to the receiving body during the printing, to blur the transferred pictures.

Thus, transfer of silicone is a serious problem for productivity and quality of ink sheets, inhibition of which is a matter of primary importance when using silicone-containing back-coat.

As a method for preventing the silicone transfer, it is proposed to disperse silicone in a binder. Silicone, however, has poor compatibility with other resins, and migrates to the surface of the back-coat with passage of time, to eventually cause the transfer. Therefore, this proposal does not provide a satisfactory solution.

As still other methods, use of an advancely grafted silicone graft polymer or of a reactive silicone to fix the silicone on a binder have been proposed. In both cases, however, unreacted silicone or free silicone decomposed from the graft polymer remains, and it is difficult to suppress silicone transfer to a negligible level.

Accordingly, the object of the present invention is to provide a thermal transfer recording film which excels in slidability on thermal heads, does not develop sticking, and causes little transfer of silicone from its back-coat.

According to the present invention, a thermal transfer recording film having a thermal transfer recording layer on one surface of the film base is provided as meeting the above object, which is characterized in that a back-coat layer containing silicone as fixed on a binder resin and a fluorine-containing surfactant is provided on the film surface which comes into sliding contact with a thermal head.

In the present invention, the "silicone" which is fixed on a binder resin signifies the silicone component chemically bonding with the binder resin in the back-coat layer.

Silicone can be fixed on a binder resin by any of such methods as graft co-polymerization of silicone with a binder resin, reaction of a reactive silicone with a binder resin, or fixation of silicone on a binder resin with a polyfunctional compound. The silicone contributes to slidability of the back-coat on thermal heads. Preferred weight ratios of the silicone component to non-silicone component, as solids, range from 1/100–100/100 (silicone/non-silicone). Preferred application rate of the back coat ranges from 0.1–5 g/m$^2$, more preferably 0.3–1.5 g/m$^2$.

Grafted silicone copolymers preferably have such a structure that polydimethylsiloxane is grafted onto polyacrylate, polyester, polyurethane, polyimide, polyamide, polyvinyl butyral, polyvinylacetal, cellulosic polymers, or the like.

As the reactive silicone, silicone into whose terminals hydroxy, amino, carboxy groups, etc. are introduced, are preferred. As the binder resin, polyacrylate, polyester, polyurethane, polyamide, polyimide, polyvinyl butyral, polyvinyl acetal, cellulosic polymers and the like can be advantageously used.

As polyfunctional compounds for fixing silicone, many compounds which are normally referred to as crosslinking agents, such as isocyanates and epoxides, can be used.

In the present invention, a fluorine-containing surfactant exhibits an action to inhibit transfer of silicone. The mechanism of this action of fluorine-containing surfactant is not yet fully clear. It is presumed, however, that a fluorine-containing surfactant which migrates to the surface of the back coat traps the free, transferable silicone present in the vicinity of the back coat surface. A fluorine compound and silicone have approximately equivalent, low levels of surface energy, and it seems plausible that the two develop a certain kind of mutual action. Moreover, fixed silicone is slower in migrating to the surface compared to free silicone, and presumably free silicone only is selectively deactivated.

The fluorine-containing surfactant is added to the coating composition preferably immediately before application of the back-coat, although such is not necessarily essential depending on the other steps in the procedure.

As the fluorine-containing surfactant, any of those commercially available can be used with no specific limitation. Fluorard ® FC430 & 431 which are manufactured by 3M are used with particular preference. The surfactant is used preferably at a ratio to the silicone of 1/10 to 1/100 (fluorine-containing surfactant-/silicone) by weight as solids.

Concurrent use of a crosslinking agent such as an isocyanate, epoxide, or the like in the back coat is preferred in the present invention. These compounds have such effects as improving thermal stability of the coating and also increasing its adherability to the base film.

According to the invention, it is also permissible to add to the back coat, as a filler or a matting agent, inorganic fine particles such as of silica, talc., calcium carbonate, silicon nitride or titanium oxide; or organic fine particles such as of fluorinated resin, silicone resin, benzoguanamine, polyethylene or polypropylene. While size of those fine particles is subject to no critical limitation, particle diameters ranging from 0.1 μm to 2 μm are preferred.

It is furthermore permissible to add an antistatic agent to the back coat. As the antistatic agent, any of commercial products of either ion-conductive surface activator type or electron-conductive type such as tin oxide, carbon black and polyaniline can be used without any critical limitation.

In the present invention, further lubricants such as waxes, phosphoric acid esters, higher straight chain fatty acid esters, or the like may be contained in the back coat supplementarily.

As the base film, polyethylene terephthalate film is used with preference in the present invention. It is also effective to use a film excelling in thermal stability, such as polyethylene naphthalate film, aromatic polyamide film, or the like. Such a base film may be subjected to an undercoating treatment or a corona treatment with the view to increase its adherability to back coat layers.

The thickness of such a film is subject to no critical limitation, while the preferred range is 2–20 μm.

As an ink to be used in an ink layer in the present invention, any known melt-transfer inks, sublimation type inks, etc. can be used without any specific limitation.

Hereinafter the invention is explained more specifically with reference to working examples, it being understood that the invention is in no way restricted thereby.

EXAMPLE 1

Onto a 5.5 μm thick, biaxially stretched polyethylene terephthalate film, a back-coat of the following composition was applied with a Mayer bar, at an application rate (dry basis) of 1 g/m$^2$.

Composition of the back-coat:

| | |
|---|---|
| Silicone-graft polymer (Diaromer ® SP712 12% methyl ethyl ketone solution, product of Dainichi Seika Kogyo K.K.) | 100 parts by weight |
| Polyisocyanate (Crossnate ® D-70 50% ethyl acetate solution, product of Dainichi Seika Kogyo K.K.) | 12 parts by weight |
| Fluorine-containing surfactant Fluorard ® FC431 50% ethyl acetate solution, product of 3M Co.) | 0.5 part by weight |
| Methyl ethyl ketone | 104 parts by weight |

Then a 3 μm-thick, sublimation type thermal transfer ink layer was provided on the surface opposite to the back-coat-applied surface of the film.

Comparative Example 1

A thermal transfer recording film was prepared in the manner identical with Example 1, except that the fluorine-containing surfactant was removed from the composition of the back-coat used in Example 1.

EXAMPLE 2

Onto a 4.5 μm-thick, biaxially stretched polyethylene terephthalate film, a back-coat of the following composition was applied with a Mayer bar, at an application rate (dry basis) of 0.5 g/m$^2$.

Composition of the back-coat:

| | |
|---|---|
| Silicone-graft polymer (Simac ® US350 30% methyl ethyl ketone solution, product of Toa Gosei Kagaku Kogyo K.K.) | 100 parts by weight |
| Polyisocyanate (Coronate ® HX 100% product of Nihon Polyurethane Kogyo) | 2.5 parts by weight |
| Fluorine-containing surfactant (Fluorard ® FC431 50% ethyl acetate solution, product of 3M Co.) | 2 parts by weight |
| Methyl ethyl ketone | 500 parts by weight |

Then a 3 μm-thick, sublimation type thermal transfer ink layer was provided on the surface opposite to the back-coat-applied surface of the film.

Comparative Example 2

A thermal transfer recording film was prepared in the manner identical with Example 2, except that the fluorine-containing surfactant was removed from the composition of the back-coat used in Example 2.

EXAMPLE 3

Onto a 5.5 μm-thick, biaxially stretched polyethylene terephthalate film, a back-coat of the following composition was applied with a Mayer bar, at an application rate (dry basis) of 1.0 g/m$^2$.

Composition of the back-coat:

| | |
|---|---|
| Polyvinyl butyral (Esrek ® BX5 product of Sekisui Kagaku) | 10 parts by weight |
| Polyisocyanate (Coronate ® HX 100% product of Nihon Polyurethane) | 4 parts by weight |
| Terminal amino-modified, reactive silicone oil (X-22-161B, product of Shin-etsu Silicone) | 3 parts by weight |
| Fluorine-containing surfactant (Fluorard ® FC431 50% ethyl acetate solution, product of 3M Co.) | 0.5 parts by weight |
| Methyl ethyl ketone | 200 parts by weight |

Then a 3-μm thick, sublimation type thermal transfer ink layer was provided on the surface opposite to the back-coat-applied surface of the film.

Comparative Example 3

A thermal transfer recording film was prepared in the manner identical with Example 3, except that the fluorine-containing surfactant was removed from the composition of the back-coat used in Example 3.

Those thermal transfer recording films prepared in the above Examples 1–3 and Comparative Examples 1–3 were each set in an ink sheet cassette in a sublimation type video printer (Hitachi VY-100). Using the printers a solid pattern of yellow, Magenta or Cyan was printed, and occurrence of sticking was examined. After the printing, the condition of each of the ink sheets was also examined.

In all of the tested films, no sticking was observed, the ink sheets ran smoothly, and after the printing no objectionable crease or breakage occurred in the ink sheets.

For evaluation of the extent of silicone transfer from the back-coats, a compulsory test was conducted as follows.

A fresh film base was superposed on the back-coat of an ink sheet to be tested, allowed to stand under a pressure (6 kg/cm$^2$) and peeled off. Then the wettability of the fresh film base which had been in contact with the back-coat of the ink sheet was measured, as the basis for evaluation of silicone transferability from the back-coat.

The results were as shown in Table 1. From the data presented in Table 1, it can be understood that the products of the present invention excel in nontransferability of silicone.

TABLE 1

| Sample | Wettability (dyn/cm) |
|---|---|
| Example 1 | 34 |
| Example 2 | 33 |
| Example 3 | 35 |
| Comparative Example 1 | no higher than 31 |
| Comparative Example 2 | do. |
| Comparative Example 3 | do. |

As so far explained, the thermal transfer recording film according to the present invention is free of sticking phenomenon, runs smoothly during printing and shows little silicone transfer from its back-coat. Consequently, the present invention enables stable production of thermal transfer recording film and noise-free printing.

What is claimed is:

1. A thermal transfer recording film having a film base and a thermal transfer recording layer on one surface of the film base, which is characterized in that a back-coat layer containing silicone as chemically bonded to a binder resin and a fluorine-containing surfactant is provided on the surface of the film which comes into sliding contact with a thermal head, in which the silicone chemically bonded to a binder resin is a graft copolymer of silicone with a binder resin or a reaction product of a terminal amino-modified reactive silicone oil with a binder resin.

2. The film as defined in claim 1, in which the grafted silicone is polydimethylsiloxane.

3. The film as defined in claim 1, in which the fluorine-containing surfactant is used at a ratio to the silicone of 1/10 to 1/100 by weight as solids.

* * * * *